US010670222B2

(12) United States Patent
Lan et al.

(10) Patent No.: US 10,670,222 B2
(45) Date of Patent: Jun. 2, 2020

(54) LIGHTING MODULE AND MOTOR VEHICLE INCLUDING THE SAME

(71) Applicant: VALEO LIGHTING HUBEI TECHNICAL CENTER CO. LTD., Wuhan (CN)

(72) Inventors: Zenghui Lan, Wuhan (CN); Zhao Fang, Wuhan (CN); Xin Zeng, Wuhan (CN)

(73) Assignee: VALEO LIGHTING HUBEI TECHNICAL CENTER CO. LTD., Wuhan (CN)

( * ) Notice: Subject to any disclaimer, the term of this patent is extended or adjusted under 35 U.S.C. 154(b) by 0 days.

(21) Appl. No.: 15/950,305

(22) Filed: Apr. 11, 2018

(65) Prior Publication Data

US 2018/0292065 A1 Oct. 11, 2018

(30) Foreign Application Priority Data

Apr. 11, 2017 (CN) ..... 2017 2 0376666 U

(51) Int. Cl.

| | |
|---|---|
| ***F21S 45/47*** | (2018.01) |
| ***F21S 45/40*** | (2018.01) |
| ***F21S 45/10*** | (2018.01) |
| ***F21S 41/24*** | (2018.01) |
| ***F21S 41/30*** | (2018.01) |

(Continued)

(52) U.S. Cl.

CPC ..... *F21S 45/47* (2018.01); *F21S 41/148* (2018.01); *F21S 41/24* (2018.01); *F21S 41/285* (2018.01); *F21S 41/30* (2018.01); *F21S 41/40* (2018.01); *F21S 45/10* (2018.01); *F21S 45/40* (2018.01); *F21Y 2115/10* (2016.08)

(58) Field of Classification Search

CPC .. F21S 45/47; F21S 45/10; F21S 41/24; F21S 41/30; F21S 41/40; F21S 41/148; F21S 41/285

See application file for complete search history.

(56) References Cited

U.S. PATENT DOCUMENTS

| | | | | |
|---|---|---|---|---|
| 9,638,382 | B2 * | 5/2017 | Pawliczek | F21S 41/19 |
| 2017/0059109 | A1 * | 3/2017 | Matsumoto | F21S 41/147 |

(Continued)

FOREIGN PATENT DOCUMENTS

| | | |
|---|---|---|
| DE | 202 09 730 U1 | 8/2002 |
| EP | 1 726 875 A1 | 11/2006 |
| EP | 2 149 748 A1 | 2/2010 |

OTHER PUBLICATIONS

Extended European Search Report dated Aug. 2, 2018 in corresponding European Patent Application No. 18 16 6649, 2 pages.

*Primary Examiner* — Anabel Ton

(74) *Attorney, Agent, or Firm* — Oblon, McClelland, Maier & Neustadt, L.L.P.

(57) ABSTRACT

A lighting module used in a motor vehicle. The lighting module includes a housing and a light source assembly provided in the housing, wherein at least one thermal baffle is provided beside the light source assembly, and a thermal resistant layer is provided on at least one portion of the thermal baffle. The present utility model also provides a motor vehicle including the lighting module. The lighting module and the motor vehicle of the present utility model can reduce high temperature damage, and can have a low cost and a compact structure.

16 Claims, 3 Drawing Sheets

(51) Int. Cl.

| | |
|---|---|
| ***F21S 41/148*** | (2018.01) |
| ***F21S 41/40*** | (2018.01) |
| ***F21S 41/20*** | (2018.01) |
| *F21Y 115/10* | (2016.01) |

(56) References Cited

U.S. PATENT DOCUMENTS

| | | | | |
|---|---|---|---|---|
| 2017/0370543 | A1* | 12/2017 | Matsumoto | F21S 41/19 |
| 2018/0231207 | A1* | 8/2018 | Shin | H01L 35/30 |

* cited by examiner

LIGHTING MODULE AND MOTOR VEHICLE INCLUDING THE SAME

BACKGROUND

Technical Field

The present utility model relates to a field of vehicle device, and more particularly, to a lighting module and a motor vehicle including a lighting module.

Description of the Related Art

In a motor vehicle, a lighting module is used to form a lighting and/or signaling device so as to meet requirements of vehicle using and driving regulations. The lighting and/or signaling device comprises a headlight, a turn signal, a brake light, a position light, a fog light, a daytime running light and the like. As a main component of the lighting module, a light source always generates a large amount of heat during use, so after the lighting module is turned on for a long time, a high temperature area will be formed directly above or around the light source (for example, a halogen bulb). The high temperature will damage components and cause premature aging of them.

To avoid high temperature damage and premature aging of the components in the vicinity of the light source, attention must be given to local high temperature phenomena. In the prior art, a method for solving this problem is to use a high-temperature-resistant material as a material for manufacturing heat-sensitive elements. However, for a structure of a modern and complicated vehicle light, a large number of components are closely arranged around the light source. If the high-temperature-resistant material is used for them, it will lead to a significant increase in costs. Another measure to avoid high temperature damage is to change the spatial layout of a light source assembly and other components, so as to maximize the distance between the light source and other components, but it runs counter to a design concept of compact vehicle light.

Therefore, there is an urgent need for a lighting module for a vehicle that is cost effective and that can improve thermal defects without increasing the size of the device.

SUMMARY

In order to alleviate the above problem, an object of the present utility model is to provide a lighting module with reduced high temperature damage.

Another object of the present utility model is to provide a low-cost lighting module.

A further object of the present utility model is to provide a lighting module with improved thermal defects and a compact structure.

A yet another object of the present utility model is to provide a motor vehicle with improved thermal performance.

In order to achieve at least one of the above objects, the technical solutions of the present utility model are as follows:

A lighting module used in a motor vehicle, the lighting module comprising a housing and a light source assembly provided in the housing, wherein at least one thermal baffle is provided beside the light source assembly, and a thermal resistant layer is provided on at least one portion of the thermal baffle.

According to a preferred embodiment of the present utility model, the lighting module further comprises an additional functional unit, wherein the thermal baffle and the thermal resistant layer provided on the thermal baffle are provided between the additional functional unit and the light source assembly.

According to a preferred embodiment of the present utility model, a surface of the thermal baffle facing the light source assembly is shaped such that a hot air flow is directed away from the additional functional unit.

According to a preferred embodiment of the present utility model, the thermal baffle comprises a main flat portion, a first bending portion extending vertically from the main flat portion and a second bending portion extending towards a direction opposite to the first bending portion from the main flat portion, so as to form a surface for directing the hot air flow.

According to a preferred embodiment of the present utility model, the thermal resistant layer is provided on the main flat portion and the second bending portion.

According to a preferred embodiment of the present utility model, the additional functional unit comprises a printed circuit board, a light emitting diode and a light guiding element, and the additional functional unit is shielded from light emitted from the light source assembly by means of a light shielding member.

According to a preferred embodiment of the present utility model, the thermal baffle is fixed to the light shielding member, and an air flow channel is formed between the thermal baffle and the light shielding member.

According to a preferred embodiment of the present utility model, the first bending portion extends away from the additional functional unit, and heat dissipating slots are provided in the first bending portion for communicating the air flow channel with the external.

According to a preferred embodiment of the present utility model, a surface of the thermal baffle facing the light source assembly and a surface of the thermal baffle away from the light source assembly each is provided with the thermal resistant layer.

According to a preferred embodiment of the present utility model, the at least one thermal baffle comprises a first thermal baffle and a second thermal baffle, the first thermal baffle and the second thermal baffle being arranged in parallel to each other such that a gap is formed between the first thermal baffle and the second thermal baffle.

According to a preferred embodiment of the present utility model, at least one surface of the first thermal baffle and/or of the second thermal baffle are provided with the thermal resistant layers.

According to a preferred embodiment of the present utility model, the gap is configured to be a vacuum enclosed compartment.

According to a preferred embodiment of the present utility model, the light source assembly comprises a light source, a reflector and an inner lens.

According to another aspect of the present utility model, there is also provided a motor vehicle comprising the lighting module according to any one of the preceding embodiments.

According to the lighting module provided by the present utility model, a thermal baffle is disposed beside a light source assembly, thus the heat released from the light source assembly can be blocked by the thermal baffle, thereby protecting the components around the light source assembly and avoiding thermally burning them. Further, a thermal resistant layer is added to the thermal baffle, and the thermal resistant layer can be made of a heat-resistant, refractory material, such as foam, glass fiber or ceramic material, thereby further preventing the heat from being transferred to an additional functional unit. In the case of a thermal baffle made of a metal with a high thermal conductivity, the addition of the thermal resistant layer is particularly advantageous, because the heat can be conducted away from the additional functional unit by means of the thermal baffle with a high thermal conductivity. At the same time, on the part of the thermal baffle, particularly, on a portion of the thermal baffle corresponding to the additional functional unit, the thermal resistant layer is provided, thereby preventing the heat from being transferred to the additional functional unit.

By means of designing a specific shape of thermal baffle, it facilitates a hot air flow from the light source assembly to be directed away from the additional functional unit. Advantageously, the thermal baffle is fixed to a light shielding member between the additional functional unit and the light source assembly, and an air flow channel is formed between the thermal baffle and the light shielding member, so as to facilitate convective diffusion of heat. The technical solution of using double thermal baffles and forming a vacuum space between the double thermal baffles further enhances the heat insulation effect of the present utility model, because the thermal baffles with a sandwich structure have stronger heat insulation capability.

In summary, the lighting module and the motor vehicle having the lighting module of the present utility model have high-efficiency heat dissipation and heat insulation performance, thereby reducing high temperature damage to the components around the light source assembly in the lighting module due to high temperature, and avoiding performance loss and premature aging of the related components. Moreover, the lighting module has less structural changes. The thermal baffle can be made of an aluminum plate or iron plate with low cost. The thermal resistant layer can be made of a known heat-resistant material, and parts of the module can be fixed by screws with lower installation cost, therefore the lighting module according to the present utility model have a lower cost. In addition, the above structure does not increase the volume of the lighting module and therefore has a compact structure.

DETAILED DESCRIPTION OF PREFERRED EMBODIMENTS

Figure 1:
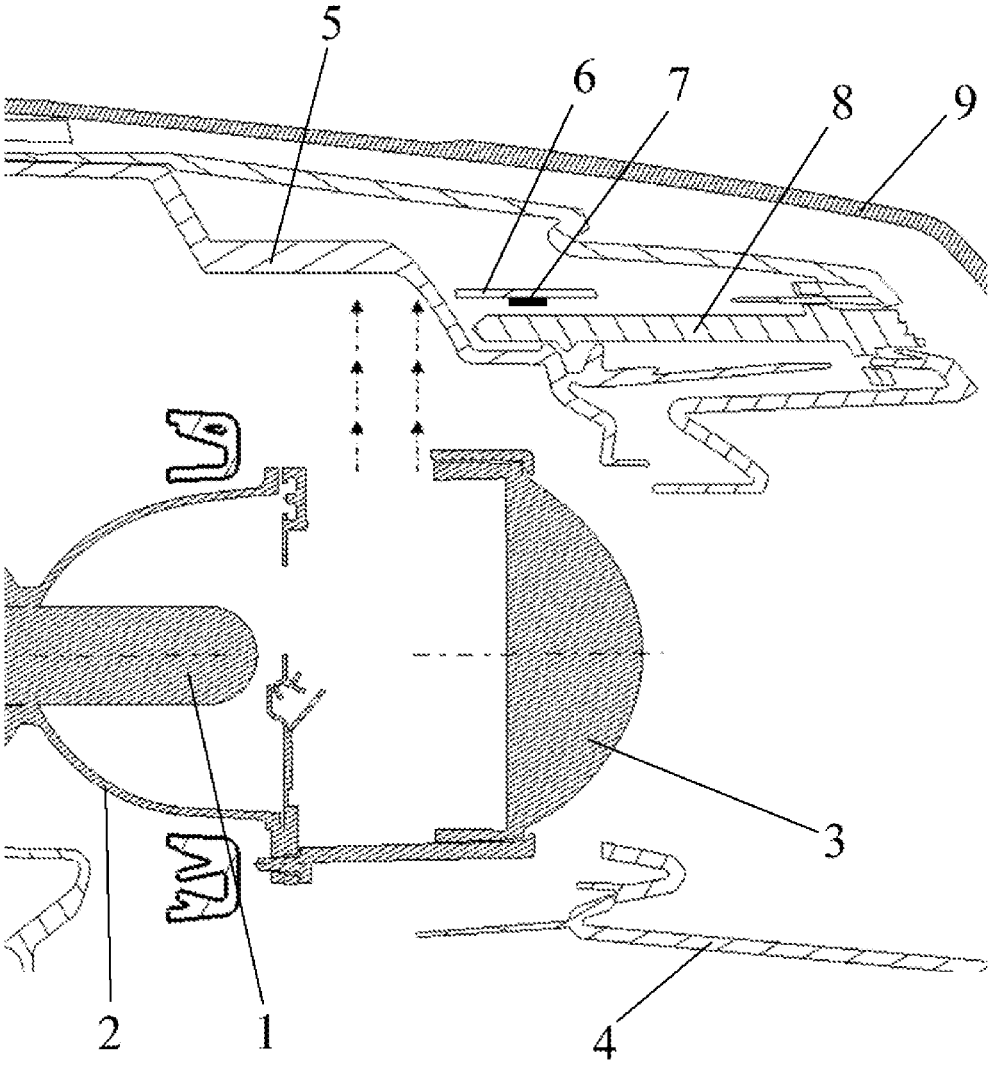
FIG. 1 shows a lighting module according to the present utility model, in which a thermal baffle and a thermal resistant layer are removed so as to show the affection of thermal diffusion.

Exemplary embodiments of the present utility model will be described in detail below with reference to the accompanying drawings in which the same or similar reference numerals represent the same or similar elements. In addition, in the following detailed description, numerous specific details are set forth in order to facilitate the explanation and provide a thorough understanding of the embodiments of the present disclosure. However, it will be apparent that the embodiment(s) may also be practiced without these specific details. In other cases, well-known structures and devices are schematically illustrated to simplify the drawings.

According to a general inventive concept of the present utility model, it provides a lighting module used in a motor vehicle, comprising a housing 4 and a light source assembly provided in the housing 4. At least one thermal baffle 10 is provided beside the light source assembly, and a thermal resistant layer 11 is provided on at least one portion of the thermal baffle 10.

In the present utility model, the term "beside" is not limited to a specific orientation, and it includes any position "above", "below", "in front of", "behind", "at left side", and "at right side" of the light source assembly, and any positions between these orientations.

According to the lighting module provided by the present utility model, a thermal baffle is disposed beside a light source assembly, thus the heat released from the light source assembly can be blocked by the thermal baffle, thereby protecting the components around the light source assembly and avoiding thermally burning them. Further, a thermal resistant layer is added to the thermal baffle, and the thermal resistant layer can be made of a heat-resistant, refractory material, such as foam, glass fiber or ceramic material, thereby further preventing the heat from being transferred to the peripheral components (for example, the additional functional unit). In case that a thermal baffle is made of a metal with a high thermal conductivity, the addition of the thermal resistant layer is particularly advantageous, because the heat can be conducted away from the additional functional unit by means of the thermal baffle with a high thermal conductivity. At the same time, on the local part of the thermal baffle, particularly, on a portion of the thermal baffle corresponding to the additional functional unit, the thermal resistant layer is provided, thereby preventing the heat from being transferred to the additional functional unit.

FIG. 1 is an overall schematic view of a lighting module according to an embodiment. In order to illustrate heat distribution of a light source assembly, the thermal baffle and the thermal resistant layer are not shown. As shown in FIG. 1, the lighting module includes a light source assembly composed of a light source 1, a reflector 2, and an inner lens 3; a housing 4, an additional functional unit (described below), and an outer lens 9. The light source assembly composed of the light source 1, the reflector 2, and the inner lens 3, the additional functional unit, and the outer lens 9 are directly or indirectly fixed to the housing 4 by a conventional fixing manner.

Here, the light source 1 may take the form of a halogen bulb, a xenon lamp, or any other common light sources. As a specific embodiment, the additional functional unit comprises a printed circuit board 6, a light emitting diode 7 and a light guiding element 8. The light emitting diode (LED) 7 is located on the printed circuit board (PCB), the light guiding element 8 is a flat light guide for conducting the light emitted by the light emitting diode 7, and the additional functional unit blocks the light emitted by the light source assembly by means of a light shielding member 5 so as to prevent the light emitted by the light source assembly from interfering with the additional functional unit. In this embodiment, the light source assembly is used as a headlight of a vehicle, which generates a large amount of heat, and the additional functional unit is provided for use as a daytime running light. However, although the present utility model is described with reference to a headlight and a daytime running light, the light source assembly and the additional functional unit may also have other types of lighting and/or signaling functions, including but not limited to a low beam, a high beam, a turn light, a brake light, a position light, a fog light, etc.

As indicated by the arrows in FIG. 1, the heat generated by the light source 1 is conducted towards the light shielding member 5 and the additional functional unit located above the light source 1, and an overheat zone is formed nearby the additional functional unit. The printed circuit board 6, the light emitting diode 7 and the light guiding element 8 are heat-sensitive elements, and the excessively high temperature may cause failure of the printed circuit board 6 and the light emitting diode 7 and change light guiding performance of the light guiding element 8, or cause premature aging of them.

Figure 2:
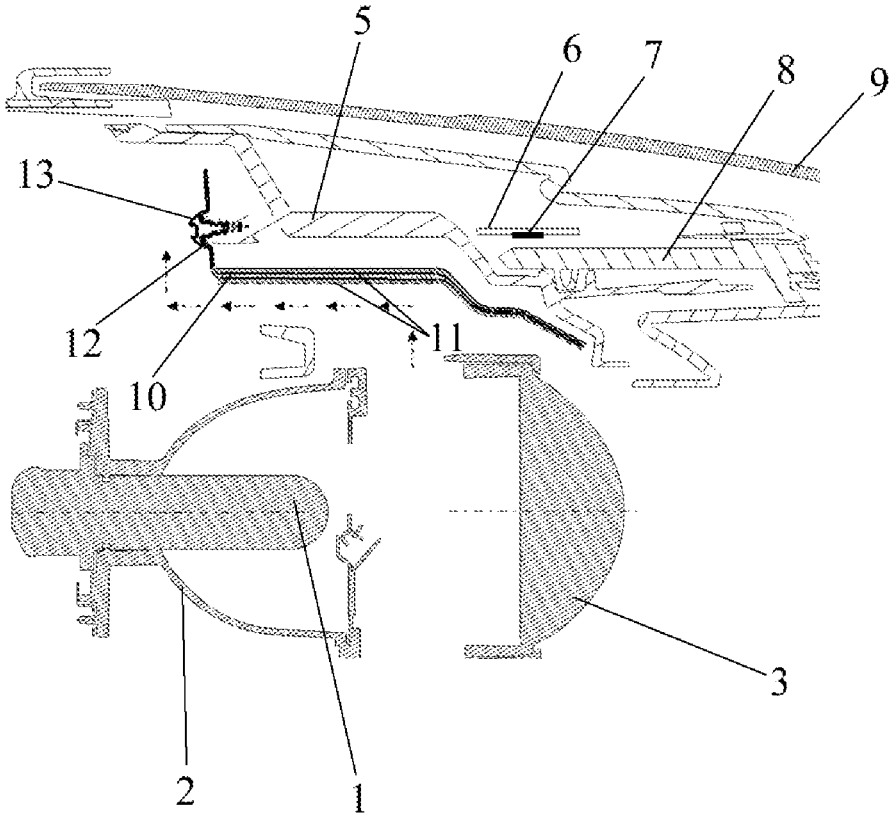
FIG. 2 is a lighting module according to an embodiment of the present utility model.

FIG. 2 is a lighting module according to an embodiment of the present utility model. As shown in FIG. 2, in addition to the same structural elements as shown in FIG. 1, a thermal baffle 10 is disposed beside the light source assembly, and a thermal resistant layer 11 is provided on a part of the thermal baffle 10. Specifically, the thermal baffle 10 and the thermal resistant layer 11 disposed on the thermal baffle 10 are disposed between the additional functional unit and the light source assembly. As an example, the thermal baffle 10 is fixed to the light shielding member 5 using a screw 13 through a fixing hole 12 provided in the thermal baffle 10. As can be seen from FIG. 2, the thermal baffle 10 is substantially parallel to the light shielding member 5, and an air flow channel is formed between the thermal baffle 10 and the light shielding member 5.

According to the present utility model, the thermal baffle 10 can be made of a metal material with a higher thermal conductivity, such as aluminum plate or iron plate. This kind of material has an advantage of lower cost. The thermal resistant layer 11 can be made of a heat-resistant and refractory material, preferably, a foam with a lower cost. The thermal resistant layer 11 can be fixed to the thermal baffle 10 by a attaching, coating or mounting manner. In the embodiment shown in the drawing, the thermal resistant layers 11 are provided on a surface of the thermal baffle 10 facing the light source assembly and a surface facing away from the light source assembly, respectively.

Figure 4:
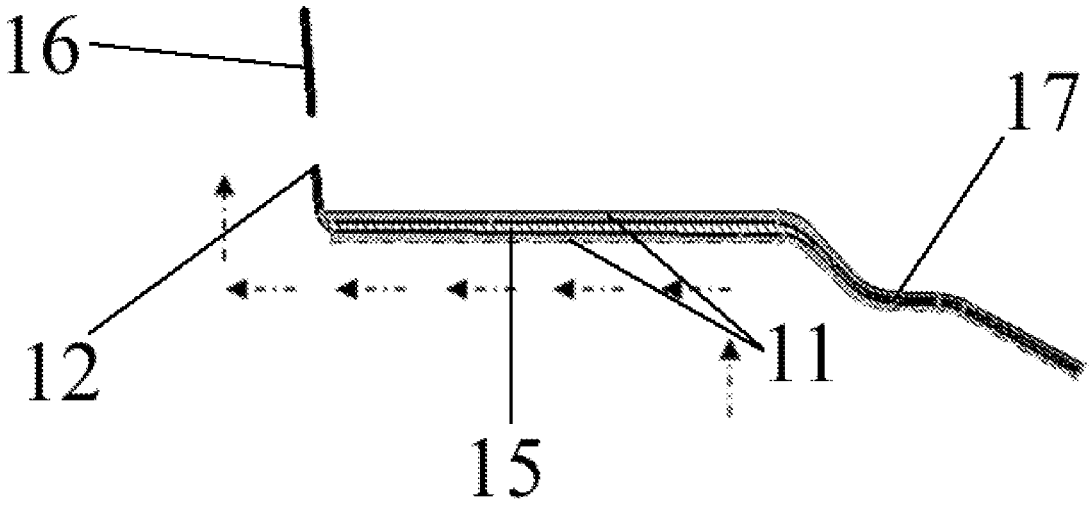
FIG. 4 is an enlarged view of a thermal baffle and a thermal resistant layer in the lighting module shown in FIG. 2.

In order to enhance the thermal performance of the thermal baffle, the surface of the thermal baffle 10 facing the light source assembly is shaped such that a hot air flow is directed away from the additional functional unit. FIG. 4 is an enlarged view of the thermal baffle and the thermal resistant layer in the lighting module shown in FIG. 2, in which the thermal baffle 10 includes a main flat portion 15, a first bending portion 16 extending vertically from the main flat portion 15 and a second bending portion 17 extending towards a direction (for example, a rearward and downward direction) opposite to the first bending portion 16 from the main flat portion 15, so as to form a surface for directing the hot air flow. As shown in FIGS. 2 and 4, the hot air flow is directed away from the additional functional unit in the direction indicated by the arrows.

Preferably, the thermal resistant layer 11 is provided on the main flat portion 15 and the second bending portion 17, while the thermal resistant layer 11 is not disposed on the first bending portion 16. The first bending portion 16 extends in such a way that it departs from the additional functional unit, and heat dissipating slots (not shown) are provided in the first bending portion 16 for communicating the air flow channel with the external.

By means of designing a specific shape of thermal baffle, it facilitates a hot air flow from the light source assembly to be directed away from the additional functional unit. Advantageously, the thermal baffle is fixed to a light shielding member between the additional functional unit and the light source assembly, and an air flow channel is formed between the thermal baffle and the light shielding member, so as to facilitate convective diffusion of heat.

Figure 3:
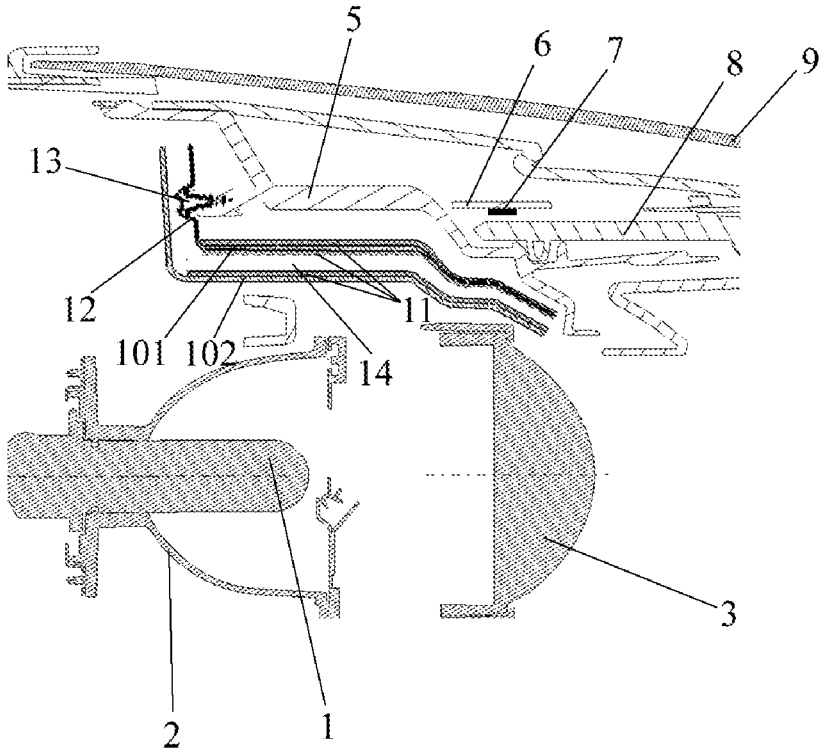
FIG. 3 is a lighting module according to another embodiment of the present utility model.

FIG. 3 shows a lighting module according to another embodiment of the present utility model. The difference between this embodiment and the embodiment shown in FIG. 2 lies in that: the lighting module includes two thermal baffles, i.e., a first thermal baffle 101 and a second thermal baffle 102. The first thermal baffle 101 and the second thermal baffle 102 are arranged in parallel to each other such that a gap 14 is formed between the first thermal baffle 101 and the second thermal baffle 102. Thermal resistant layers 11 are provided on surfaces of the first thermal baffle 101 and the second thermal baffle 102 facing each other, respectively, while thermal resistant layers 11 are provided on surfaces of the first thermal baffle 101 and the second thermal baffle 102 facing away from each other, respectively. Advantageously, the gap 14 is configured as a closed compartment and the closed compartment is of a vacuum environment.

It should be noted that, it is possible that at least one surface of the first thermal baffle 101 and/or of the second thermal baffle 102 are provided with the thermal resistant layers 11 thereon.

The technical solution of using double thermal baffles and forming a vacuum space between the double thermal baffles further enhances the heat insulation effect of the present utility model, because the thermal baffles with a sandwich structure have stronger heat insulation capability.

Further, the thermal baffle may include portions with different thermal conductivities. For example, a portion having a high thermal conductivity close to the light source assembly and a portion having a low thermal conductivity close to the additional functional unit may be used to facilitate the heat to be dissipated, but not to be directed to the additional functional unit.

According to another aspect of the present utility model, it also provides a motor vehicle including the lighting module according to any one of the preceding embodiments.

In summary, the lighting module and the motor vehicle having the lighting module of the present utility model have high-efficiency heat dissipation and heat insulation performance, thereby reducing high temperature damage to the components around the light source assembly in the lighting module due to high temperature, and avoiding performance loss and premature aging of the related components. Moreover, the lighting module has less structural changes, the thermal baffle can be made of an aluminum plate or iron plate with low cost, the thermal resistant layer can be made of a known heat-resistant material, and parts of the module can be fixed by screws with lower installation cost, therefore the lighting module according to the present utility model have a lower cost. In addition, the above structure does not increase the volume of the lighting module and therefore has a compact structure.

While the embodiments of the present utility model have been shown and described, variations and modifications may be made to these embodiments by those skilled in the art without departing from the principles and spirit of the present utility model. The scope of the present utility model is defined by the appended claims and equivalents thereof.

REFERENCE NUMERAL LIST

1 light source
2 reflector

3 inner lens
4 housing
5 light shielding member
6 printed circuit board
7 light emitting diode
8 light guiding element
9 outer lens
10 thermal baffle
11 thermal resistant layer
12 fixing hole
13 screw
14 gap
15 main flat portion
16 first bending portion
17 second bending portion
101 first thermal baffle
102 second thermal baffle

What is claimed is:

1. A lighting module used in a motor vehicle, the lighting module comprising:

a housing;

a light source assembly provided in the housing; and an additional functional unit, wherein at least one thermal baffle is provided beside the light source assembly, and a thermal resistant layer is provided on at least one portion of the thermal baffle, the at least one thermal baffle including a main flat portion, a first bending portion extending vertically from the main flat portion and a second bending portion extending towards a direction opposite to the first bending portion from the main flat portion, and wherein the thermal baffle and the thermal resistant layer provided on the thermal baffle are provided between the additional functional unit and the light source assembly.

2. The lighting module according to claim 1, wherein a surface of the thermal baffle facing the light source assembly is shaped such that a hot air flow is directed away from the additional functional unit.

3. The lighting module according to claim 1, wherein the thermal resistant layer is provided on the main flat portion and the second bending portion.

4. The lighting module according to claim 1, wherein the additional functional unit comprises a printed circuit board, a light emitting diode and a light guiding element, and the additional functional unit is shielded from light emitted from the light source assembly by means of a light shielding member.

5. The lighting module according to claim 4, wherein the thermal baffle is fixed to the light shielding member, and an air flow channel is formed between the thermal baffle and the light shielding member.

6. The lighting module according to claim 5, wherein the first bending portion extends away from the additional functional unit, and heat dissipating slots are provided in the first bending portion for communicating the air flow channel with the external.

7. A lighting module used in a motor vehicle, the lighting module comprising:

a housing; and a light source assembly provided in the housing, wherein at least one thermal baffle is provided beside the light source assembly, the at least one thermal baffle including a main flat portion, a first bending portion extending vertically from the main flat portion and a second bending portion extending towards a direction opposite to the first bending portion from the main flat portion, and a thermal resistant layer is provided on at least one portion of the thermal baffle, and wherein a surface of the thermal baffle facing the light source assembly and a surface of the thermal baffle away from the light source assembly each is provided with the thermal resistant layer.

8. A lighting module used in a motor vehicle, the lighting module comprising:

a housing; and a light source assembly provided in the housing, wherein at least one thermal baffle is provided beside the light source assembly, the at least one thermal baffle including a main flat portion, a first bending portion extending vertically from the main flat portion and a second bending portion extending towards a direction opposite to the first bending portion from the main flat portion, and a thermal resistant layer is provided on at least one portion of the thermal baffle, and wherein the at least one thermal baffle comprises a first thermal baffle and a second thermal baffle, the first thermal baffle and the second thermal baffle being arranged in parallel to each other such that a gap is formed between the first thermal baffle and the second thermal baffle.

9. The lighting module according to claim 8, wherein at least one surface of the first thermal baffle and/or of the second thermal baffle are provided with the thermal resistant layers.

10. The lighting module according to claim 8, wherein the gap is configured to be a vacuum enclosed compartment.

11. The lighting module according to claim 1, wherein the light source assembly comprises a light source, a reflector and an inner lens.

12. A motor vehicle comprising the lighting module according to claim 1.

13. The lighting module according to claim 1, wherein the light source assembly comprises a light source, a reflector and an inner lens.

14. A motor vehicle comprising the lighting module according to claim 1.

15. The lighting module according to claim 2, wherein the light source assembly comprises a light source, a reflector and an inner lens.

16. A motor vehicle comprising the lighting module according to claim 2.

* * * * *